US008455424B2

(12) United States Patent
Siegert et al.

(10) Patent No.: US 8,455,424 B2
(45) Date of Patent: Jun. 4, 2013

(54) **DETERGENTS AND CLEANING AGENTS CONTAINING PROTEASES FROM *BACILLUS PUMILUS***

(75) Inventors: Petra Siegert, Haan (DE); Astrid Spitz, Moers (DE); Karl-Heinz Maurer, Erkrath (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 13/117,188

(22) Filed: May 27, 2011

(65) Prior Publication Data

US 2011/0230384 A1 Sep. 22, 2011

Related U.S. Application Data

(63) Continuation of application No. PCT/EP2009/065200, filed on Nov. 16, 2009.

(30) Foreign Application Priority Data

Nov. 27, 2008 (DE) ..... 10 2008 059 447

(51) Int. Cl.
*C11D 3/386* (2006.01)

(52) U.S. Cl.
USPC ..... 510/306

(58) Field of Classification Search
None
See application file for complete search history.

(56) References Cited

U.S. PATENT DOCUMENTS

| | | | |
|---|---|---|---|
| 4,898,621 | A | 2/1990 | Pruehs et al. |
| 5,346,822 | A | 9/1994 | Vetter et al. |
| 6,417,151 | B1 | 7/2002 | Grothus et al. |
| 7,300,782 | B2 | 11/2007 | Breves et al. |
| 7,510,859 | B2 | 3/2009 | Wieland et al. |
| 2004/0259222 | A1 | 12/2004 | Breves et al. |
| 2007/0128129 | A1 | 6/2007 | Stehr et al. |
| 2009/0170745 | A1 | 7/2009 | Merkel et al. |
| 2009/0275493 | A1 | 11/2009 | Siegert et al. |

FOREIGN PATENT DOCUMENTS

| | | | |
|---|---|---|---|
| DE | 102006022224 | * | 11/2007 |
| EP | 0678573 B1 | * | 11/2000 |
| GB | 1473202 A | | 5/1977 |
| WO | 9523221 A1 | | 8/1995 |
| WO | 2005056782 A2 | | 6/2005 |
| WO | 2009053157 A1 | | 4/2009 |

OTHER PUBLICATIONS

A_Geneseq_201206 database Acc#AZE81394 from DE102006022224 (Nov, 15, 2007). Alignment with SEQ ID No. 3.*

Altschul, Stephen F. et al. "Basic Local Alignment Search Tool." J. Mol. Biol., vol. 215, 1990, pp. 403-410.

Altschul, Stephen F. et al. "Gapped BLAST and PSI-BLAST: a new generation of protein database search programs." Nucleic Acids Research, vol. 25, No. 17, 1997, pp. 3389-3402.

Chenna, Ramu, et al. "Multiple sequence alignment with the Clustal series of programs." Nucleic Acids Research, vol. 31, No. 13, 2003, pp. 3497-3500.

Notredame, Cedric, et al. "T-Coffee: A Novel Method for Fast and Accurate Multiple Sequence Alignment." J. Mol. Biol., vol. 302, 2000, pp. 205-217.

DelMar, E.G., et al. "A Sensitive new Substrate for Chymotrysin." Analytical Biochemistry, vol. 99, 1979, pp. 316-320.

Gornall, Allan G., et al. "Determination of Serum Proteins By Means of The Biuret Reaction." J. Biol. Chem., vol. 177, 1948, pp. 751-766.

Bernhard, K., et al."Bacteriocin and Antibiotic Resistance Plasmids in *Bacillus cereus* and *Bacillus subtilis*." Journal of Bacteriology, vol. 133, No. 2, Feb. 1978, pp. 897-903.

Kawamura, Fujio, et al. "Construction of a *Bacillus subtilis* Double Mutant Deficient in Extracellular Alkaline and Neutral Proteases." Journal of Bacteriology, vol. 160, No. 1, Oct. 1984, pp. 442-444.

*Bacillus pumilus* F036B, Human Genome Sequencing Center, Baylor College of Medicine, Retreived from http://www.hgsc.bcm.tmc.edu/projects/microbial/microbial-index on Jun. 23, 2011.

Van Raay, Hans Georg et al. "Zur Bestimmung der proteolytischen Aktivitaot in Enzymkonzentraten und enzymhaltigen Wasch-, Suel- und Reinigungsmitteln." [Determination of the Proteolytic Enzyme Activity in Enzyme-containing Concentrates and Laundry Detergents, Dishwashing Detergents and Cleaning Agents.] Tenside Detergents, May/Jun. 1970, p. 125-131. (Summary in English on p. 131.).

Fritsch, Sambrook et al. "Molecular cloning: a laboratory manual." Cold Springs Harbour Laboratory Press, 1989.

* cited by examiner

*Primary Examiner* — Sheridan Swope
(74) *Attorney, Agent, or Firm* — Ingrassia Fisher & Lorenz, P.C.

(57) ABSTRACT

Detergents and cleaning agents containing a protease having an amino acid sequence being at least 97.5% identical to the amino acid sequence given in SEQ ID NO. 3. The detergents and cleaning agents exhibit an excellent cleaning action on protease-sensitive soiling.

19 Claims, No Drawings

DETERGENTS AND CLEANING AGENTS CONTAINING PROTEASES FROM *BACILLUS PUMILUS*

CROSS REFERENCE TO RELATED APPLICATIONS

The present application is a continuation of International Patent Application No. PCT/EP2009/065200 filed 16 Nov. 2009, which claims priority to German Patent Application No. 10 2008 059 447.4 filed 27 Nov. 2008, both of which are incorporated herein by reference.

The present patent application is directed towards washing and cleaning agents containing a protease from *Bacillus pumilus*. The application is further directed towards cleaning methods in which these agents are used, and uses of these agents. The application is moreover directed towards cleaning methods utilizing the proteases, and use of the proteases for washing and cleaning purposes.

Up to now it has been preferred to use proteases of the subtilisin type for washing and cleaning agents. Proteases used in the washing or cleaning agents known from the existing art either derive originally from microorganisms (e.g., the genera *Bacillus, Streptomyces, Humicola*, or *Pseudomonas*) and/or are produced in accordance with biotechnological methods known per se by suitable microorganisms, for example, by transgenic expression hosts of the *Bacillus* species, or by filamentous fungi.

Examples include the subtilisins BPN' and Carlsberg, protease PB92, subtilisins 147 and 309, the alkaline protease from *Bacillus lentus*, particularly from *Bacillus lentus* DSM 5483, subtilisin DY, and the enzymes (classified, however, as subtilases and no longer as subtilisins in the strict sense) thermitase, proteinase K, and the proteases TW3 and TW7. Other usable proteases include the enzymes obtainable under the trade names Durazym®, Relase®, Everlase®, Nafizym, Natalase®, Kannase®, and Ovozyme® from the Novozymes company, under the trade names Purafect®, Purafect® OxP, Purafect® Prime, and Properase® from the Genencor company, under the trade name Protosol® from Advanced Biochemicals Ltd., Thane, India, under the trade name Wuxi® from Wuxi Snyder Bioproducts Ltd., China, under the trade names Proleather® and Protease P® from Amano Pharmaceuticals Ltd., Nagoya, Japan, and under the designation Proteinase K-16 from Kao Corp., Tokyo, Japan.

Proteases from *Bacillus pumilus* are also known from the existing art. International application WO 2007/131656, for example, discloses a protease from *Bacillus pumilus*, and also proposes it as an ingredient for washing and cleaning agents.

It is by no means true, however, that any protease can also produce satisfactory cleaning performance in a washing agent. Instead, even proteases which derive from phylogenetically closely related organisms, for example, different *Bacillus pumilus* strains, exhibit very different cleaning performance levels in washing or cleaning agents. Many proteases are therefore not suitable for use in washing or cleaning agents.

A disadvantage of washing and cleaning agents containing proteases of the existing art is that the proteases contained do not exhibit satisfactory proteolytic activity, particularly at low temperatures, for example, from 10° C. to 50° C., particularly from 10° C. to 40° C., or from 20° C. to 40° C., and the washing or cleaning agent therefore does not display optimum cleaning performance, especially not in the respective temperature range, and in particular not on protease-sensitive stains. A need therefore exists to discover novel proteases, particularly novel microbial proteases, for use in washing and cleaning agents, and to make available corresponding novel washing and cleaning agents containing such proteases.

The present invention therefore provides washing or cleaning agents having improved cleaning performance, particularly with respect to stains that are sensitive to breakdown by proteases. The present invention further makes available washing or cleaning agents having improved cleaning performance at lower temperatures, particularly from 10° C. to 50° C. and preferably from 10° C. to 40° C., particularly with respect to stains that are sensitive to breakdown by proteases. These washing or cleaning agents should display improved removal of at least one stain that is sensitive to breakdown by a protease, particularly in a temperature range from 10° C. to 50° C. and preferably from 10° C. to 40° C. Washing or cleaning agents according to the present invention preferably display improved removal of multiple stains. In particular, these washing or cleaning agents should contain proteases, and particularly preferably naturally occurring proteases, which are notable for their contribution to the cleaning performance of an agent containing the protease at least approaching and ideally exceeding the contribution to the cleaning performance of the agent of a proteolytic enzyme established for that purpose.

A subject of the invention is therefore a washing or cleaning agent containing a protease having an amino acid sequence that is at least 97.5%, and increasingly preferably at least 98%, 98.1%, 98.2%, 98.3%, 98.4%, 98.5%, 98.6%, 98.7%, 98.8%, 98.9%, 99%, 99.1%, 99.2%, 99.3%, 99.4%, 99.5%, 99.6%, 99.7%, 99.8%, 99.9%, and very particularly 100% identical to the amino acid sequence indicated in SEQ ID NO. 3, as well as at least one further washing-agent ingredient.

It has been found, surprisingly, that a protease of this kind is advantageously usable in a washing or cleaning agent, and imparts to it an advantageous cleaning performance in particular at low temperatures as well, for example, from 10° C. to 50° C., particularly from 10° C. to 40° C. or from 20° C. to 40° C. An agent of this kind therefore makes possible improved removal of at least one, preferably multiple protease-sensitive stains on textiles and/or hard surfaces, for example tableware.

The protease present in washing or cleaning agents according to the present invention is, as may be gathered from the Examples, obtainable from the culture supernatant of a *Bacillus* strain identified by the DSMZ (=Deutsche Sammlung von Mikroorganismen and Zellkulturen GmbH [German Collection of Microorganisms and Cell Cultures], Inhoffenstraβe 7 B, D-38124 Braunschweig, Germany) as a *Bacillus pumilus* strain. The strain and soil sample containing it derive from Minneapolis, USA. For purposes of reprocessability, a plasmid containing the nucleic acid sequence of this protease was deposited at the DSMZ under deposit number DSM 21890, in accordance with the Budapest Treaty.

A protease contained in a washing or cleaning agent according to the present invention has a proteolytic activity (i.e., it is capable of hydrolyzing peptide bonds of a polypeptide or protein). It is therefore an enzyme that catalyzes the hydrolysis of peptide bonds and is thereby able to cleave peptides or proteins, particularly a subtilisin. For purposes of the present invention, "enzymes," "proteins," "fragments," and "derivatives," unless they need to be explicitly addressed as such, are grouped under the general term "proteins" or "polypeptides," since a protein is a polypeptide.

Protease according to the present invention present in a washing or cleaning agent is suitable for use in washing and cleaning agents due to its proteolytic activity and its further properties, particularly its stability in terms of surfactants and/or bleaching agents and/or its temperature profile and/or its pH profile. Surprisingly, even in its wild type form, it contributes to the cleaning performance of a washing or cleaning agent containing the protease which is so good that it approaches—and in fact, on a variety of stains, exceeds—the contribution to cleaning performance of an agent containing a proteolytic enzyme established for that purpose. This is even more surprising considering that in bacteria of phylogenetically-related bacterial strains, particularly various *Bacillus pumilus* strains, proteases that differ with regard to their usability in washing or cleaning agents are present (i.e., not all proteases from *Bacillus pumilus* are appropriate for this). Proteases used in agents according to the present invention are suitable for this. Upon application of a washing and cleaning agent containing them, they produce satisfactory removal of one or more protein-containing stains, particularly when used in the aforementioned temperature ranges. They therefore possess under the demanding application conditions of washing and cleaning agents a sufficiently high proteolytic activity to break down protein-containing stains under the utilization conditions of the washing or cleaning agent. Demanding application conditions are produced in washing and cleaning agents due to the presence of one or more additional ingredients (e.g., bleaching agents, bleach activators, surfactants, builder substances) in those agents and in the washing bath formed by them during the washing operation, and/or because of the pH value of such agents and the washing bath formed by them during the washing operation, and/or because of the ionic strength and/or temperature of the washing bath during the washing operation. "Cleaning performance" according to the present invention refers to the brightening performance of a washing or cleaning agent on stains, particularly on protease-sensitive stains and among those in particular on protease-sensitive laundry stains. Cleaning performance is preferably ascertained as indicated below.

Numerous proteases, particularly subtilisins, are formed as preproteins (i.e., together with a propeptide and a signal peptide, the signal peptide typically ensuring discharge of the protease out of the cell that produces it and into the periplasma or medium surrounding the cell, and the propeptide usually being necessary for correct folding of the protease). The signal peptide and propeptide are usually the N-terminal part of the preprotein. Under natural conditions, the signal peptide is cleaved off from the remainder of the protease by a signal peptidase. This is followed by correct final folding, assisted by the propeptide, of the protease. The protease is then in its active form and cleaves off the propeptide itself. After cleavage of the propeptide, the now-mature protease, in particular subtilisin, exerts its catalytic activity without the originally present N-terminal amino acids.

For technical applications the mature proteases (i.e., the processed enzymes after manufacture) are preferred (because of their enzymatic activity) over the preproteins. The proteases can be modified after manufacture of the polypeptide chain by the cells producing them (e.g., by attachment of sugar molecules, by formylation, amination, etc.). Such modifications are referred to as post-translational modifications. These post-translational modifications can but do not necessarily exert an influence on the function of the protease.

The nucleic acid sequence of a protease contained in a washing or cleaning agent according to the present invention is indicated under SEQ ID NO. 1. This nucleic acid codes for a protease that exhibits a division, typical of subtilisins, into a signal peptide, propeptide, and mature protease. The full-length protein is indicated under SEQ ID NO. 2, and the mature protease under SEQ ID NO. 3. This means the actually active mature protein, since this performs the technically relevant function. Washing or cleaning agents particularly preferred according to the present invention therefore contain the mature, active proteases. These have a molecular weight of between 25 and 30 kD (kilodaltons), in particular 27 kD, ascertained by SDS polyacrylamide gel electrophoresis.

For the protease according to SEQ ID NO. 3 or SEQ ID NO. 2, a sequence analysis and a sequence comparison with known protein sequences from the generally accessible databases UniProtKB and/or Swiss-Prot (cf. UniProtKB, EMBL Outstation—European Bioinformatics Institute, Wellcome Trust Genome Campus, Hinxton, Cambridge CB 10 1 SD, United Kingdom) and/or GenBank (National Center for Biotechnology Information NCBI, National Institutes of Health, Bethesda, Md., USA) were performed in order to identify proteins having the greatest similarity. This sequence comparison was performed using the BLAST algorithm that is established in the existing art and usually used (cf., e.g., Altschul, S. F., Gish, W., Miller, W., Myers, E. W. & Lipman, D. J. (1990) "Basic local alignment search tool." J. Mol. Biol., 215, pp. 403-410, and Altschul, Stephan F., Thomas L. Madden, Alejandro A. Schaffer, Jinghui Zhang, Hheng Zhang, Webb Miller, and David J. Lipman (1997): "Gapped BLAST and PSI-BLAST: a new generation of protein database search programs", Nucleic Acids Res., 25, pp. 3389-3402). A further algorithm available in the art is the FASTA algorithm.

The comparison with the these databases yielded a database entry that is 100% identical to the amino acid sequence indicated in SEQ ID NO. 2. It is database entry B2FUW7 (UniProtKB/TrEMBL (B2FUW7_BACPU)) or the database entry AM748727 (Genbank) or its translation CAO03040.1 ("*Bacillus pumilus* sapB gene for serine alkaline protease preproprotein"). This entry deviates in one amino acid position from the amino acid sequence indicated under SEQ ID NO. 3 of the mature protein.

The entry contig00263 of the genome sequencing of *Bacillus pumilus* F036B (Baylor College of Medicine, Houston, Tex., USA) further discloses an amino-acid sequence that is 100% identical to the amino-acid sequence indicated in SEQ ID NO. 2.

These database entries do not, however, disclose washing or cleaning agents containing such a protease or protease similar to this protease, nor do the entries contain information about the advantageous applicability of corresponding proteases in washing or cleaning agents.

The identity of nucleic-acid or amino-acid sequences is determined by sequence comparison. A comparison of this kind with known enzymes deposited, for example, in generally accessible databases, also allows a deduction based on the amino-acid or nucleotide sequence as to the enzymatic activity of an enzyme in question. This activity can be qualitatively or quantitatively modified by other regions of the protein that do not participate in the actual reaction. This might relate, for example, to enzyme stability, activity, reaction conditions, or substrate specificity.

A comparison of this kind is made by mutual association of similar successions in the nucleotide sequences (or amino-acid sequences). A tabular association of the relevant positions is referred to as an "alignment". In the analysis of nucleotide sequences, consideration must be given to both complementary strands, and to all three possible reading frames in each case, and to the degeneracy of the genetic code and the organism-specific codon usage. Sequence comparisons and alignments are usually prepared using computer programs. Clustal (cf., e.g., Chenna et al. (2003), "Multiple sequence alignment with the Clustal series of programs", *Nucleic Acid Research,* 31, pp. 3497-3500), or T-Coffee (cf., e.g., Notredame et al. (2000), "T-Coffee: A novel method for multiple sequence alignments", *J. Mol. Biol.,* 302, pp. 205-217), and BLAST or FASTA, for example, are often used for the database search, as well as programs based on these programs or algorithms. In the present application, sequence comparisons and alignments were prepared using the computer program Vector NTI® Suite 7.0 (Invitrogen Corporation, 1600 Faraday Avenue, Carlsbad, Calif., USA) with the predefined default parameters.

A comparison of this kind also allows a conclusion as to the similarity to one another of the sequences that are being compared. This is usually indicated as a percentage identity (i.e., the proportion of identical nucleotides or amino acid residues at the same positions or in positions corresponding to one another in an alignment). A broader construction of the term "homology" in the context of amino-acid sequences also incorporates consideration of the conserved amino acid exchanges (i.e., amino acids having a similar chemical activity), since these usually perform similar chemical activities within the protein. The similarity of the compared sequences can therefore also be indicated as a "percentage homology" or "percentage similarity". Indications of identity and/or homology can be encountered over entire polypeptides or genes or only over individual regions. Homologous or identical regions of various nucleic-acid or amino-acid sequences are therefore defined by way of matches in the sequences. Such regions often exhibit identical functions. They can be small and encompass only a few nucleotides or amino acids. Small regions of this kind often perform functions essential to the overall activity of the protein. It may therefore be useful to refer sequence matches only to individual, and optionally small, regions. Unless otherwise indicated, however, indications of identity or homology in the present application refer to the full length of the respectively indicated nucleic-acid or amino-acid sequence.

It has been found that a washing and cleaning agent having a protease according to the present invention exhibits elevated cleaning performance with respect to a protease-free agent and achieves very good cleaning performance in terms of protease-sensitive stains.

In a further preferred embodiment of the invention, a washing or cleaning agent according to the present invention is characterized in that its cleaning performance at least corresponds to that of a washing or cleaning agent which contains a protease in accordance with SEQ ID NO. 3 and/or which contains a protease in accordance with SEQ ID NO. 4, and/or which contains a protease that corresponds to the protease from *Bacillus pumilus* in accordance with WO 2007/131656, the cleaning performance being determined in a washing system that contains a washing agent at a dosing ratio of between 4.5 and 7.0 grams per liter of washing bath as well as the protease, the proteases to be compared being used on an equal-activity basis and the cleaning performance being determined with respect to one or more of the following stains: blood-milk/ink on cotton, whole egg/pigment (whole egg/carbon black) on cotton, chocolate-milk/carbon black on cotton, peanut oil-pigment/ink on polyester/cotton, grass on cotton, and cocoa on cotton, in particular with respect to one or more of the following stains:

- blood-milk/ink on cotton: product no. C-05 obtainable from CFT (Center for Testmaterials) B.V., Vlaardingen, Netherlands,
- whole egg/pigment (whole egg/carbon black) on cotton: product no. 10N obtainable from wfk Testgewebe GmbH; Brüggen-Bracht, Germany, or product C-S-37 obtainable from CFT (Center for Testmaterials) B.V., Vlaardingen, Netherlands,
- chocolate-milk/carbon black on cotton: product no. C-03 obtainable from CFT (Center for Testmaterials) B.V., Vlaardingen, Netherlands,
- peanut oil-pigment/ink on polyester/cotton: product no. PC-10 obtainable from CFT (Center for Testmaterials) B.V., Vlaardingen, Netherlands,
- grass on cotton: product no. 164 obtainable from Eidgenossische Material-und Prüfanstalt (EMPA) Testmaterialien AG [Federal materials and testing agency, Testmaterials], St. Gallen, Switzerland,
- cocoa on cotton: product no. 112 obtainable from Eidgenössische Material- und Prüfanstalt (EMPA) Testmaterialien AG, St. Gallen, Switzerland, by measuring the whiteness of the washed textiles, the washing procedure being performed for at least 30 minutes, optionally 60 minutes, at a temperature of 40° C., and the water having a water hardness from 15.5 to 16.5° (German degrees of hardness).

According to the present invention, the terms "whole egg/carbon black" and "whole egg/pigment" are to be regarded, in terms of stains, as being equivalent and mutually corresponding.

A preferred liquid washing agent for a washing system of this kind has the following composition (all indications in percentage by weight): 0.3 to 0.5% xanthan gum, 0.2 to 0.4% antifoaming agent, 6 to 7% glycerol, 0.3 to 0.5% ethanol, 4 to 7% FAEOS (fatty alcohol ether sulfate), 24 to 28% nonionic surfactants, 1% boric acid, 1 to 2% sodium citrate (dihydrate), 2 to 4% soda, 14 to 16% coconut fatty acid, 0.5% HEDP (1-hydroxyethane-(1,1-diphosphonic acid)), 0 to 0.4% PVP (polyvinylpyrrolidone), 0 to 0.05% optical brighteners, 0 to 0.001% dye, remainder deionized water. The dosing ratio of the liquid washing agent is preferably from 4.5 to 6.0 grams per liter of washing bath, for example, 4.7, 4.9, or 5.9 grams per liter of washing bath. Washing preferably occurs in a pH range of from pH 8 to pH 10.5, preferably from pH 8 to pH 9.

A preferred powdered washing agent for a washing system of this kind has the following composition (all indications in percentage by weight): 10% linear alkylbenzenesulfonate (sodium salt), 1.5% C12 to C18 fatty alcohol sulfate (sodium salt), 2.0% C12 to C18 fatty alcohol with 7 EO, 20% sodium carbonate, 6.5% sodium hydrogencarbonate, 4.0% amorphous sodium disilicate, 17% sodium carbonate peroxohydrate, 4.0% TAED, 3.0% polyacrylate, 1.0% carboxymethyl cellulose, 1.0% phosphonate, 25% sodium sulfate; remainder: optionally foam inhibitors, optical brighteners, scents, and if applicable water to make 100%. The dosing ratio of the powdered washing agent is preferably between 5.5 and 7.0 grams per liter of washing bath, for example 5.6, 5.9, or 6.7 grams per liter of washing bath. Washing preferably occurs in a pH range of from pH 9 to pH 11.

It is preferred according to the present invention if the aforementioned liquid washing agent is used, as indicated, to determine the cleaning performance.

Whiteness (i.e., the brightening of the stains) is determined as an indication of washing performance, preferably using optical measurement methods, preferably photometrically. A device suitable for this is, for example, the Minolta CM508d spectrometer. The devices used for measurement are usually calibrated beforehand using a white standard, preferably a white standard provided with the unit.

Equal-activity utilization of the respective protease ensures that the respective enzymatic properties (e.g., the cleaning performance on specific stains) are compared even if there is some drifting apart of the ratio of active substance to total protein (the values for specific activity). It is generally the case that a low specific activity can be compensated for by adding a larger quantity of protein. Methods for determining enzyme activities are familiar to one skilled in the art of enzyme technology, and are applied by him or her on a routine basis. Such methods are disclosed, for example, in Tenside, Vol. 7 (1970), pp. 125-132.

Alternatively, protease activity can be determined quantitatively by the release of para-nitroaniline (pNA) chromophore from the suc-L-Ala-L-Ala-L-Pro-L-Phe-p-nitroanilide substrate (AAPF). The protease cleaves the substrate and releases pNA. The release of pNA causes an increase in extinction at 410 nm, the change in which over time is an indication of enzymatic activity (see Del Mar et al., 1979). Measurement is performed at a temperature of 25° C., at pH 8.6, and a wavelength of 410 nm. The measurement time is 5 min, and the measurement interval 20 s to 60 s.

Protease activity is usually indicated in protease units (PU). Suitable protease activities, for example, are 2.5, 5 or 10 PU per ml of washing bath. Protease activity is not, however, equal to zero.

Included among washing and cleaning agents according to the present invention are all conceivable types of washing or cleaning agents, both concentrates and agents used in undiluted form, for use on a commercial scale, in washing machines, or for hand laundering or cleaning. These include, for example, washing agents for textiles, carpets, or natural fibers, for which the term "washing agent" is used. Also included are, for example, dishwashing agents for automatic dishwashers, or manual dishwashing agents, or cleaners for hard surfaces such as metal, glass, porcelain, ceramic, tiles, stone, painted surfaces, plastics, wood, or leather, for which the term "cleaning agent" is used.

An agent according to the present invention preferably contains the protease in an amount of from 2 μg to 20 mg, preferably 5 μg to 17.5 mg, more preferably from 20 μg to 15 mg, and very preferably from 50 μg to 10 mg per g of agent.

An agent according to the present invention can be both for large-scale consumers or technical users as well as for the individual consumer. All types of washing and cleaning agent established in the existing art likewise represent embodiments of the present invention.

Washing or cleaning agents according to the present invention, which can be present as, in particular, powdered solids, in recompressed particle form, or as homogeneous solutions or suspensions, can contain, in addition to proteases used according to the present invention, all known ingredients typically found in such agents, with at least one further ingredient preferably present in the agent. Agents according to the present invention can contain, in particular, builder substances, surface-active surfactants, bleaching agents based on organic and/or inorganic peroxygen compounds, bleach activators, water-miscible organic solvents, enzymes, sequestering agents, electrolytes, pH regulators, and further adjuvants such as optical brighteners, anti-gray agents, foam regulators, and dyes and scents, as well as combinations thereof.

A combination of a protease with one or more further ingredient(s) present in a washing or cleaning agent according to the present invention proves to be particularly advantageous, since such an agent exhibits improved cleaning performance because of synergisms that can result between the protease and the further ingredient. This means that the agent brings about improved removal of stains, for example, protein-containing stains, either as compared with an agent that contains only one of the two components or also as compared with the expected cleaning performance of an agent having both components based on simply adding the respective individual contributions of those two components to the cleaning performance of the agent. Such a synergism can be achieved by combining a protease contained in a washing or cleaning agent according to the present invention with one of the surfactants and/or builder substances and/or bleaching agents described below.

Agents according to the present invention can contain a surfactant or multiple surfactants. Anionic surfactants, nonionic surfactants, and mixtures thereof, as well as cationic, zwitterionic, and amphoteric surfactants are possibilities.

Suitable nonionic surfactants include alkyl glycosides and ethoxylation and/or propoxylation products of alkyl glycosides, or linear or branched alcohols each having 12 to 18 carbon atoms in the alkyl portion and 3 to 20, by preference 4 to 10, alkyl ether groups. Also usable are corresponding ethoxylation and/or propoxylation products of N-alkylamines, vicinal diols, fatty acid esters and fatty acid amides that correspond in terms of the alkyl portion to the aforesaid long-chain alcohol derivatives, and of alkylphenols having 5 to 12 carbon atoms in the alkyl residue.

Nonionic surfactants used are preferably alkoxylated, advantageously ethoxylated, particularly primary alcohols having 8 to 18 carbon atoms and an average of 1 to 12 mol ethylene oxide (EO) per mol of alcohol, in which the alcohol residue can be linear or preferably methyl-branched in the 2-position, or can contain mixed linear and methyl-branched residues, such as those that are usually present in oxo alcohol residues. Particularly preferred, however, are alcohol ethoxylates having linear residues made up of alcohols of natural origin having 12 to 18 carbon atoms (e.g., from coconut, palm, tallow, or oleyl alcohol) and an average of 2 to 8 EO per mol of alcohol. Included among the preferred ethoxylated alcohols are, for example, $C_{12}$ to $C_{14}$ alcohols with 3 EO or 4 EO, $C_9$ to $C_{11}$ alcohols with 7 EO, $C_{13}$ to $C_{15}$ alcohols with 3 EO, 5 EO, 7 EO, or 8 EO, $C_{12}$ to $C_{18}$ alcohols with 3 EO, 5 EO, or 7 EO, and mixtures thereof, such as mixtures of $C_{12}$ to $C_{14}$ alcohol with 3 EO and $C_{12}$ to $C_{18}$ alcohol with 7 EO. The degrees of ethoxylation indicated represent statistical averages, which can be an integral or a fractional number for a specific product. Preferred alcohol ethoxylates exhibit a restricted distribution of homologs (narrow range ethoxylates, NRE). In addition to these nonionic surfactants, fatty alcohols with more than 12 EO can also be used. Examples of these are (tallow) fatty alcohols with 14 EO, 16 EO, 20 EO, 25 EO, 30 EO, or 40 EO. Especially in agents for use in automatic methods, it is usual to use extremely low-foaming compounds. These include, preferably, $C_{12}$ to $C_{18}$ alkylpolyethylene glycol-polypropylene glycol ethers having respectively up to 8 mol ethylene oxide and propylene oxide units in the molecule. It is also, however, possible to use other known low-foaming nonionic surfactants such as $C_{12}$ to $C_{18}$ alkylpolyethylene glycol-polybutylene glycol ethers having respectively up to 8 mol ethylene oxide and butylene oxide units in the molecule, as well as end-capped alkylpolyalkylene glycol mixed ethers. Also particularly preferred are the hydroxyl-group-containing alkoxylated alcohols such as those described in European Patent Application EP 0 300 305 (so-called hydroxy mixed ethers). Also included among the nonionic surfactants are alkyl glycosides of the general formula $RO(G)_x$, wherein R is a primary straight-chain or methyl-branched, especially methyl-branched in the 2-position, aliphatic residue having 8 to 22, preferably 12 to 18 carbon atoms, and G is a glycose unit having 5 or 6 carbon atoms, preferably glucose. The degree of oligomerization x, which indicates the distribution of monoglycosides and oligoglycosides, is any number (which, as a magnitude determined analytically, can also assume fractional values) from 1 to 10. Preferably, x is 1.2 to 1.4. Also suitable are polyhydroxy fatty acid amides of formula (III) in which $R^1CO$ is an aliphatic acyl residue having 6 to 22 carbon atoms; $R^2$ is hydrogen, an alkyl or hydroxyalkyl residue having 1 to 4 carbon atoms; and [Z] is a linear or branched polyhydroxyalkyl residue having 3 to 10 carbon atoms and 3 to 10 hydroxyl groups:

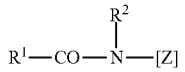

(III)

The polyhydroxy fatty acid amides are preferably derived from reducing sugars having 5 or 6 carbon atoms, in particular from glucose. Also belonging to the group of the polyhydroxy fatty acid amides are compounds of formula (IV):

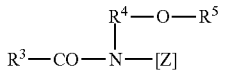

(IV)

in which $R^3$ is a linear or branched alkyl or alkenyl residue having 7 to 12 carbon atoms; $R^4$ is a linear, branched, or cyclic alkylene residue or an arylene residue having 2 to 8 carbon atoms; and $R^5$ is a linear, branched, or cyclic alkyl residue or an aryl residue or an oxyalkyl residue having 1 to 8 carbon atoms, $C_1$ to $C_4$ alkyl or phenyl residues being preferred; and [Z] is a linear polyhydroxyalkyl residue whose alkyl chain is substituted with at least two hydroxyl groups, or alkoxylated, preferably ethoxylated or propoxylated, derivatives of that residue. Here as well, [Z] is preferably obtained by reductive amination of a sugar such as glucose, fructose, maltose, lactose, galactose, mannose, or xylose. The N-alkoxy- or N-aryloxy-substituted compounds can then be converted into the desired polyhydroxy fatty acid amides, for example, by reaction with fatty acid methyl esters in the presence of an alkoxide as catalyst. A further class of nonionic surfactants used in preferred fashion, which are used either as the sole nonionic surfactant or in combination with other nonionic surfactants, particularly together with alkoxylated fatty alcohols and/or alkyl glycosides, are alkoxylated, preferably ethoxylated or ethoxylated and propoxylated, fatty acid alkyl esters, preferably having 1 to 4 carbon atoms in the alkyl chain, particularly fatty acid methyl esters. Nonionic surfactants of the amine oxide type, for example, N-cocalkyl-N,N-dimethylamine oxide and N-tallowalkyl-N,N-dihydroxyethylamine oxide, and the fatty acid alkanolamides, can also be suitable. The amount of these nonionic surfactants is preferably no more than that of the ethoxylated fatty alcohols, particularly no more than half thereof.

Further useful surfactants are so-called Gemini surfactants. These are generally understood to refer to those compounds having two hydrophilic groups per molecule. These groups are usually separated from one another by a so-called "spacer." This spacer is usually a carbon chain, which should be sufficiently long that the hydrophilic groups are far enough apart that they can act mutually independently. Surfactants of this kind generally have an unusually low critical micelle concentration, and an ability to greatly reduce the surface tension of water. In exceptional cases the expression "Gemini surfactants" is understood to mean not only such dimeric, but also correspondingly "trimeric" surfactants. Suitable Gemini surfactants include sulfated hydroxy mixed ethers or dimeralcohol bis- and trimeralcohol tris-sulfates and ether sulfates. End-capped dimeric and trimeric mixed ethers are notable in particular for their bi- and multifunctionality. For example, the aforesaid end-capped surfactants possess good wetting properties and are also low-foaming, so that they are particularly suitable for use in automatic washing or cleaning methods. Gemini polyhydroxy fatty acid amides or polypolyhydroxy fatty acid amides can, however, also be used. The sulfuric acid monoesters of straight-chain or branched $C_7$ to $C_{21}$ alcohols ethoxylated with 1 to 6 mol ethylene oxide, such as 2-methyl-branched $C_9$ to $C_{11}$ alcohols with an average of 3.5 mol ethylene oxide (EU) or $C_{12}$ to $C_{18}$ fatty alcohols with 1 to 4 EO, are also suitable.

Also included among the preferred anionic surfactants are the salts of alkylsulfosuccinic acid, which are also referred to as sulfosuccinates or as sulfosuccinic acid esters and represent the monoesters and/or diesters of sulfosuccinic acid with alcohols, by preference fatty alcohols and in particular ethoxylated fatty alcohols. Preferred sulfosuccinates contain $C_8$ to $C_{18}$ fatty alcohol residues or mixtures thereof. Particularly preferred sulfosuccinates contain a fatty alcohol residue that is derived from ethoxylated fatty alcohols that, considered per se, represent nonionic surfactants. Sulfosuccinates whose fatty alcohol residues derive from ethoxylated fatty alcohols having a restricted homolog distribution are, in turn, particularly preferred. It is likewise also possible to use alk(en)ylsuccinic acid having by preference 8 to 18 carbon atoms in the alk(en)yl chain, or salts thereof. Further possible anionic surfactants are fatty acid derivatives of amino acids, for example of N-methyltaurine(taurides) and/or of N-methyglycine(sarcosides). Particularly preferred in this context are the sarcosides or sarcosinates, and here especially sarcosinates of higher and, if applicable, mono- or polyunsaturated fatty acids, such as oleyl sarcosinate.

Further appropriate anionic surfactants are, in particular, soaps. Saturated fatty acid soaps, such as the salts of lauric acid, myristic acid, palmitic acid, stearic acid, hydrogenated erucic acid and behenic acid, are suitable in particular, as are soap mixtures derived in particular from natural fatty acids, e.g. coconut, palm-kernel, or tallow fatty acids. Known alkenylsuccinic acid salts can also be used together with these soaps or as a substitute agent for soaps.

Anionic surfactants, including the soaps, can be present in the form of their sodium, potassium, or ammonium salts and as soluble salts of organic bases such as mono-, di-, or triethanolamine. Anionic surfactants are preferably present in the form of their sodium or potassium salts, particularly their sodium salts.

Surfactants can be present in agents according to the present invention at quantitative proportions of from 5 wt % to 50 wt %, particularly from 8 wt % to 30 wt %.

Agents according to the present invention preferably contain at least one water-soluble and/or water-insoluble, organic and/or inorganic builder. Water-soluble organic builder substances include polycarboxylic acids, particularly citric acid and sugar acids, monomeric and polymeric aminopolycarboxylic acids, in particular methylglycinediacetic acid, nitrilotriacetic acid, and ethylenediaminetetraacetic acid, as well as polyaspartic acid, polyphosphonic acids, in particular aminotris(methylenephosphonic acid), ethylenediaminetetrakis(methylenephosphonic acid), and 1-hydroxyethane-1,1-diphosphonic acid, polymeric hydroxy compounds such as dextrin, and (poly)carboxylic acids, in particular the polycarboxylates, accessible by the oxidation of polysaccharides or dextrins, polymeric acrylic acids, methacrylic acids, maleic acids, and mixed polymers thereof, which can also contain, polymerized into them, small concentrations of polymerizable substances without carboxylic-acid functionality. The relative molecular weight of the homopolymers of unsaturated carboxylic acids is generally from 3000 to 200,000, that of the copolymers from 2000 to 200,000, preferably 30,000 to 120,000, based in each case on free acid. A particularly preferred acrylic acid/maleic acid copolymer has a relative molecular weight from 30,000 to 100,000. Commercially usual products are, for example, Sokalan® CP 5, CP 10, and PA 30 of the BASF company. Suitable (although less preferred) compounds of this class are copolymers of acrylic acid or methacrylic acid with vinyl ethers, such as vinylmethyl ethers, vinyl esters, ethylene, propylene, and styrene, in which the proportion of acid is at least 50 wt %. It is also possible to use, as water-soluble organic builder substances, terpolymers having two unsaturated acids and/or salts thereof as monomers and, as a third monomer, vinyl alcohol and/or an esterified vinyl alcohol or a carbohydrate. The first acid monomer or its salt is derived from an ethylenically monounsaturated $C_3$ to $C_3$ carboxylic acid and by preference from a $C_3$ to $C_4$ monocarboxylic acid, in particular from (meth) acrylic acid. The second acid monomer or its salt can be a derivative of a $C_4$ to $C_8$ dicarboxylic acid (maleic acid being particularly preferred) and/or a derivative of an allylsulfonic acid that is substituted in the 2-position with an alkyl or aryl residue. Such polymers generally have a relative molecular weight between 1000 and 2,000,000. Further preferred copolymers are those that comprise, as monomers, by preference acrolein and acrylic acid/acrylic acid salts, or vinyl acetate. In particular for the manufacture of liquid agents, the organic builder substances can be used in the form of aqueous solutions, by preference in the form of 30- to 50-weight-percent aqueous solutions. All the aforesaid acids are generally used in the form of their water-soluble salts, in particular their alkali salts.

Organic builder substances of this kind can be present, if desired, in quantities of up to 40 wt %, in particular up to 25 wt %, and by preference from 1 wt % to 8 wt %. Quantities close to the aforementioned upper limit are used by preference in pasty or liquid, in particular hydrous, agents according to the present invention.

Suitable water-soluble inorganic builder materials include alkali silicates, alkali carbonates, and alkali phosphates, which can be present in the form of their alkaline, neutral, or acid sodium or potassium salts. Examples thereof are trisodium phosphate, tetrasodium diphosphate, disodium dihydrogendiphosphate, pentasodium triphosphate, so-called sodium hexametaphosphate, oligomeric trisodium phosphate having degrees of oligomerization from 5 to 1000, in particular 5 to 50, and the corresponding potassium salts, or mixtures of sodium and potassium salts. Crystalline or amorphous alkali aluminosilicates are used in particular as water-insoluble, water-dispersible inorganic builder materials, in quantities of up to 50 wt %, by preference not above 40 wt %, and in liquid agents in particular from 1 wt % to 5 wt %. Among these, the crystalline sodium aluminosilicates of washing-agent quality, in particular zeolite A, P, and if applicable X, alone or in mixtures, for example in the form of a co-crystal of zeolites A and X (Vegobond® AX, a commercial product of Condea Augusta S.p.A.) are preferred. Quantities close to the aforesaid upper limit are used by preference in solid, particulate agents. Suitable aluminosilicates exhibit, in particular, no particles having a particle size greater than 30 μm, and by preference are made up of at least 80 wt % particles having a size less than 10 μm. Their calcium binding capability, which can be determined as indicated in German Patent DE 24 12 837, is generally in the range from 100 to 200 mg CaO per gram.

Suitable substitutes or partial substitutes for the aforesaid aluminosilicate are crystalline alkali silicates, which can be present alone or mixed with amorphous silicates. Alkali silicates usable in agents according to the present invention as detergency builders preferably have a molar ratio of alkali oxide to $SiO_2$ below 0.95, in particular from 1:1.1 to 1:12, and can be present in amorphous or crystalline fashion. Preferred alkali silicates include sodium silicates, particularly the amorphous sodium silicates, having a $Na_2O:SiO_2$ molar ratio from 1:2 to 1:2.8. Crystalline sheet silicates of the general formula $Na_2Si_xO_{2x+1}.yH_2O$, in which the modulus x is a number from 1.9 to 22, particularly 1.9 to 4, and y is a number from 0 to 33, with preferred values for x are 2, 3, or 4, are preferred for use as crystalline silicates, which can be present alone or mixed with amorphous silicates. Preferred crystalline sheet silicates are those in which x in the aforesaid general formula is 2 or 3. In particular, both ®- and ™-sodium disilicates ($Na_2Si_2O_5.yH_2O$) are particularly preferred. Practically anhydrous crystalline alkali silicates manufactured from amorphous alkali silicates and having the aforesaid general formula, in which x denotes a number from 1.9 to 2.1, can be used in agents according to the present invention. In a further preferred embodiment of agents according to the present invention, a crystalline sodium sheet-form silicate having a modulus from 2 to 3 can be used, such as one manufactured from sand and soda. Crystalline sodium silicates having a modulus in the range from 1.9 to 3.5 are used in a further preferred embodiment of agents according to the present invention. Crystalline sheet-form silicates of formula (I) indicated above are marketed by Clariant GmbH under the trade name Na-SKS, e.g. Na-SKS-1 ($Na_2Si_{22}O_{45}.xH_2O$, kenyaite), Na-SKS-2 ($Na_2Si_{14}O_{29}.xH_2O$, magadiite), Na-SKS-3 ($Na_2Si_8O_{17}.x\ H_2O$), or Na-SKS-4 ($Na_2Si_4O_9.xH_2O$, makatite). Particularly suitable among these are Na-SKS-5 ((—$Na_2Si_2O_5$), Na-SKS-7 (®-$Na_2Si_2O_5$, natrosilite), Na-SKS-9 ($NaHSi_2O_5.3H_2O$), Na-SKS-10 ($NaHSi_2O_5.3H_2O$, kanemite), Na-SKS-11 (t-$Na_2Si_2O_5$), and Na-SKS-13 ($NaHSi_2O_5$), but in particular Na-SKS-6 (™-$Na_2Si_2O_5$). In a preferred embodiment of agents according to the present invention, a granular compound of crystalline sheet silicate and citrate, of crystalline sheet silicate and aforementioned (co)polymeric polycarboxylic acid, or of alkali silicate and alkali carbonate, is used, for example as obtainable commercially under the name Nabion® 15.

Builder substances can be present in agents according to the present invention in quantities of up to 75 wt %, particularly 5 wt % to 50.

Peroxygen compounds suitable for use in agents according to the present invention include organic peracids or peracid salts of organic acids such as phthalimidopercapronic acid, perbenzoic acid, or salts of diperdodecanedioic acid, hydrogen peroxide, and inorganic salts that release hydrogen peroxide under washing conditions, such as perborate, percarbonate, persilicate, and/or persulfate such as caroate. If solid peroxygen compounds are used, they can be utilized in the form of powders or granulates, which can also be encased in known fashion. If an agent according to the invention contains peroxygen compounds, they are present in quantities of preferably up to 50 wt %, particularly from 5 wt % to 30 wt %. The addition of small quantities of known bleaching-agent stabilizers, for example, phosphonates, borates or metaborates, and metasilicates, as well as magnesium salts such as magnesium sulfate, may be useful.

Compounds that under perhydrolysis conditions yield aliphatic peroxocarboxylic acids having preferably 1 to 10 carbon atoms, in particular 2 to 4 carbon atoms, and/or (optionally substituted) perbenzoic acid, can be used as bleach activators. Substances that carry the O- and/or N-acyl groups having the aforesaid number of carbon atoms, and/or optionally substituted benzoyl groups, are suitable. Multiply acylated alkylenediamines, particularly tetraacetylethylendiamine (TAED), acylated triazine derivatives, particularly 1,5-diacetyl-2,4-dioxohexahydro-1,3,5-triazine (DADHT), acylated glycolurils, particularly tetraacetyl glycoluril (TAGU), N-acylimides, particularly N-nonanoyl succinimide (NOSI), acylated phenolsulfonates, particularly n-nonanoyl or isononanoyl oxybenzenesulfonate (n- or iso-NOBS), carboxylic acid anhydrides, particularly phthalic acid anhydride, acylated polyvalent alcohols, particularly triacetin, ethylene glycol diacetate, 2,5-diacetoxy-2,5-dihydrofuran, and enol esters, as well as acetylated sorbitol and mannitol and described mixtures thereof (SORMAN), acylated sugar derivatives, particularly pentaacetylglucose (PAG), pentaacetylfructose, tetraacetylxylose and octaacetyllactose, as well as acetylated, optionally N-alkylated glucamine and gluconolactone, and/or N-acylated lactams, for example, N-benzoylcaprolactam, are preferred. Hydrophilically substituted acyl acetates and acyl lactams are also used in preferred fashion. Combinations of conventional bleach activators can also be used. Especially when the hydrogen peroxide-yielding bleaching agents are present, such bleach activators can be contained in the usual quantity range, preferably in quantities from 0.5 wt % to 10 wt %, particularly 1 wt % to 8 wt %, based on the entire agent; but they are preferably entirely absent when percarboxylic acid is used as the only bleaching agent.

In addition to or instead of conventional bleach activators, sulfonimines and/or bleach-intensifying transition-metal salts or transition-metal complexes can also be present as bleach catalysts.

Included among the organic solvents usable (alongside water) in agents according to the invention, especially when the latter exist in liquid or pasty form, are alcohols having 1 to 4 carbon atoms, particularly methanol, ethanol, isopropanol, and tert.-butanol, diols having 2 to 4 carbon atoms, particularly ethylene glycol and propylene glycol, and mixtures thereof, and the ethers derivable from the aforesaid compound classes. Water-miscible solvents of this kind are present in agents according to the invention preferably in amounts not above 30 wt %, particularly from 6 wt % to 20 wt %.

In order to establish a desired pH that does not result spontaneously from mixture of the other components, the agents according to the present invention can contain system-compatible and environmentally compatible acids, particularly citric acid, acetic acid, tartaric acid, malic acid, lactic acid, glycolic acid, succinic acid, glutaric acid, and/or adipic acid, but also mineral acids, particularly sulfuric acid, or bases, particularly ammonium hydroxides or alkali hydroxides. pH regulators of this kind are present in agents according to the invention in quantities preferably not above 20 wt %, particularly from 1.2 wt % to 17 wt %.

Anti-gray agents keep dirt that has been detached from the fibers suspended in the washing bath. Water-soluble colloids, usually organic in nature, are suitable for this, for example, starch, size, gelatin, salts of ethercarboxylic acids or ethersulfonic acids of starch or of cellulose, or salts of acid sulfuric acid esters of cellulose or of starch. Water-soluble polyamides containing acid groups are also suitable for this purpose. Starch products other than those cited above can also be used, for example, aldehyde starches. It is preferred to use cellulose ethers such as carboxymethyl cellulose (Na salt), methyl cellulose, hydroxyalkyl cellulose, and mixed ethers such as methylhydroxyethyl cellulose, methylhydroxypropyl cellulose, methylcarboxymethyl cellulose, and mixtures thereof, for example, in quantities from 0.1 to 5 wt % based on the agent.

Textile washing agents according to the invention can contain as optical brighteners derivatives of diaminostilbenedisulfonic acid or its alkali metal salts, although when used as color washing agents they are preferably free of optical brighteners. Suitable, for example, are salts of 4,4'-bis(2-anilino-4-morpholino-1,3,5-triazinyl-6-amino)stilbene-2,2'-disulfonic acid, or compounds of similar structure that carry, instead of the morpholino group, a diethanolamino group, a methylamino group, an anilino group, or a 2-methoxyethylamino group. Brighteners of the substituted diphenylstyryl type can also be present (e.g., the alkali salts of 4,4'-bis(2-sulfostyryl)diphenyl, of 4,4'-bis(4-chloro-3-sulfostyryl)diphenyl, or of 4-(4-chlorostyryl)-4'-(2-sulfostyryl)diphenyl). Mixtures of the aforesaid optical brighteners can also be used.

For use in automatic washing methods in particular, it can be advantageous to add usual foam inhibitors to the agents. Suitable foam inhibitors include soaps of natural or synthetic origin having a high proportion of $C_{18}$ to $C_{24}$ fatty acids. Suitable non-surfactant foam inhibitors include organopolysiloxanes and mixtures thereof with microfine, optionally silanated silicic acid, as well as paraffins, waxes, microcrystalline waxes, and mixtures thereof with silanated silicic acid or bis-fatty acid alkylenediamides. Mixtures of different foam inhibitors, for example, those made of silicones, paraffins, or waxes, are also used with advantage. Foam inhibitors, particularly silicone- and/or paraffin-containing foam inhibitors, are preferably bound to a carrier substance that is soluble or dispersible in water. Mixtures of paraffins and bistearylethylenediamide are particularly preferred in this context.

The ingredients selected, as well as the conditions under which the agent is used, for example, temperature, pH, ionic strength, redox conditions, or mechanical influences, should be optimized for the particular cleaning problem. Usual temperatures for washing and cleaning agents range, for example, from 10° C. to 40° C. and 60° C. and up to 95° C. for automatic agents or industrial applications. Because the temperature in modern washing machines and dishwashers is usually steplessly adjustable, all intermediate steps of temperature are also included. The ingredients of the relevant agents are preferably coordinated with one another. Synergies with regard to cleaning performance are preferred. Particularly preferred in this regard are synergies that are present in a temperature range from 10° C. to 60° C., particularly from 10° C. to 60° C., from 10° C. to 50° C., from 10° C. to 40° C., from 10° C. to 30° C., from 15° C. to 30° C., from 10° C. to 25° C., and from 15° C. to 25° C.

Manufacture of solid agents according to the present invention presents no difficulties and can be accomplished in known fashion, for example, by spray-drying or granulation; enzymes and any further thermally sensitive ingredients, such as bleaching agents, can if applicable be added separately later on. A method comprising an extrusion step is preferred for the manufacture of agents according to the present invention having an elevated bulk weight, in particular in the range from 650 g/l to 950 g/l.

For the manufacture of agents according to the present invention in the form of tablets, which can be single-phase or multiple-phase, single-colored or multi-colored, and in particular can be made up of one layer or of multiple layers, in particular two layers, it is preferable to proceed in such a way that all the constituents (if applicable, of a respective layer) are mixed together in a mixer, and the mixture is compressed by means of conventional tablet presses, for example eccentric presses or rotary presses, at compression pressures in the range from approximately 50 N to 100 kN, by preference at 60 to 70 kN. With multi-layer tablets in particular, it may be advantageous if at least one layer is pre-compressed. This is carried out preferably at compression pressures between 5 and 20 kN, in particular at 10 to 15 kN. Break-resistant tablets that are nevertheless sufficiently rapidly soluble under the utilization conditions, having fracture strength and flexural strength values normally from 100 to 200 N but preferably above 150 N, are thereby obtained without difficulty. A tablet manufactured in this fashion preferably has a weight from 10 to 50 g, in particular from 15 g to 40 g. The tablets can have any three-dimensional shape, for example, round, oval, or polygonal, intermediate shapes also being possible. Corners and edges are advantageously rounded. Round tablets by preference have a diameter from 30 mm to 40 mm. In particular, the size of polygonal or cuboidal tablets which are introduced predominantly via the metering apparatus of, for example, the automatic dishwasher, depends on the geometry and volume of that metering apparatus. Embodiments that are preferred by way of example have a base outline of (20 to 30 mm)×(34 to 40 mm), in particular of 26×36 mm or 24×38 mm.

Liquid or pasty agents according to the present invention in the form of solutions containing usual solvents are generally manufactured by simply mixing the ingredients, which can be introduced into an automatic mixer in substance or as a solution.

Embodiments of the present invention thus encompass all solid, powdered, liquid, gelled, or pasty administration forms of the agents, which, if applicable, can also be made up of multiple phases and can be present in compressed or uncompressed form. A further embodiment of the invention is therefore represented by agents characterized in that they exist as one-component systems. Such agents are preferably made up of one phase. Agents made up of multiple phases are divided into multiple components. Further included among the solid administration forms according to the present invention are extrudates, granulates, tablets, or pouches, which can be present both in large containers and packaged in portions.

An agent according to the present invention can exist as a pourable powder having a bulk weight from 300 g/l to 1200 g/l, particularly 500 g/l to 900 g/l or 600 g/l to 850 g/l.

Alternatively, agents according to the present invention can also be liquid, gelled, or pasty. A further embodiment of the invention is therefore characterized in that the washing or cleaning agent exists in liquid, gelled, or pasty form, in particular in the form of a nonaqueous liquid washing agent or a nonaqueous paste or in the form of an aqueous liquid washing agent or a hydrous paste.

The washing or cleaning agent according to the present invention can be packaged in a receptacle, preferably an air-permeable receptacle, from which it is released shortly before use or during the washing operation. In particular, the protease present in the agent and/or further ingredients of the agent can further be encased with a substance impermeable to the enzyme at room temperature or in the absence of water and which becomes permeable to the enzyme under utilization conditions. One such embodiment of the invention is thus characterized in that the protease is encased with a substance that is impermeable to the protease at room temperature or in the absence of water.

Washing or cleaning agents according to the present invention can contain exclusively a protease as described. Alternatively, they can also contain further hydrolytic enzymes or other enzymes, in a concentration useful for the effectiveness of the agent. A further subject of the invention is thus represented by agents that moreover encompass one or more additional enzymes, all enzymes established in the existing art for these purposes being usable in principle. All enzymes that can display catalytic activity in the agent according to the present invention are preferably usable as further enzymes, particularly a protease, amylase, cellulase, hemicellulase, mannanase, tannase, xylanase, xanthanase, ®-glucosidase, carrageenase, oxidase, oxidoreductase, or a lipase, as well as, by preference, mixtures thereof. These enzymes are in principle of natural origin; proceeding from the natural molecules, improved variants are available for use in washing and cleaning agents and are used in correspondingly preferred fashion.

Agents according to the present invention contain enzymes preferably in total quantities from $1\times10^{-8}$ to 5 weight percent, based on active protein. The enzymes are contained in agents according to the present invention preferably from 0.001 to 5 wt %, more preferably from 0.01 to 5 wt %, even more preferably from 0.05 to 4 wt %, and particularly preferably from 0.075 to 3.5 wt %, such that each enzyme contained can be present in the aforesaid quantitative ratios. The enzymes can be adsorbed onto carrier substances and/or embedded into encasing substances in order to protect them from premature inactivation.

Protein concentration can be determined by known methods, for example, the BCA method (bichinchoninic acid; 2,2'-biquinolyl-4,4'-dicarboxylic acid) or the biuret method (A. G. Gornall, C. S. Bardawill and M. M. David, J. Biol. Chem., 177 (1948), pp. 751-766).

When comparing the performance of two washing-agent enzymes, a distinction must be made between equal-protein and equal-activity utilization. Equal-protein utilization is applied especially in the context of preparations obtained by genetic engineering that are largely free of secondary activity. The reason is that it is thereby possible to ascertain whether the same quantities of protein—as an indication of the fermentative production yield—lead to comparable results. If the respective ratios of active substance to total protein (the values for specific activity) diverge from one another, an equal-activity comparison is recommended, since this compares the respective enzymatic properties. It is generally the case that a low specific activity can be compensated for by adding a larger quantity of protein.

Particularly preferably, the enzymes exhibit synergistic effects in terms of their action with respect to specific stains or spots (i.e., the enzymes contained in the agent composition mutually assist one another in their cleaning performance). Most preferably, a synergism of this kind exists between the protease contained according to the present invention and a further enzyme of an agent according to the present invention, in particular between the aforesaid protease and an amylase and/or a mannanase and/or a lipase. Synergistic effects can exist not only between different enzymes, but also occur in particular between one or more enzymes and further ingredients of the agent according to the present invention.

Among the proteases, those of the subtilisin type are preferred. Examples thereof are the subtilisins BPN' and Carlsberg, protease PB92, subtilisins 147 and 309, the alkaline protease from *Bacillus lentus*, subtilisin DY, and the enzymes (classified, however, as subtilases and no longer as subtilisins in the strict sense) thermitase, proteinase K, and proteases TW3 and TW7. Subtilisin Carlsberg is obtainable in further developed form under the trade name Alcalase® from Novozymes A/S, Bagsærd, Denmark. Subtilisins 147 and 309 are marketed by Novozymes under the trade names Esperase® and Savinase®, respectively. The protease variants listed under the designation BLAP® are derived from the protease from *Bacillus lentus* DSM 5483. Other usable proteases are, for example, the enzymes obtainable under the trade names Durazym®, Relase®, Everlase®, Nafizym®, Natalase®, Kannase®, and Ovozymes® from Novozymes, under the trade names Purafect®, Purafect® OxP, Purafect® Prime, Excellase®, and Properase® from Genencor, under the trade name Protosol® from Advanced Biochemicals Ltd., Thane, India, under the trade name Wuxi® from Wuxi Snyder Bioproducts Ltd., China, under the trade names Proleather® and Protease P® from Amano Pharmaceuticals Ltd., Nagoya, Japan, and under the designation Proteinase K-16 from Kao Corp., Tokyo, Japan. The proteases from *Bacillus gibsonii* and *Bacillus pumilus*, which are disclosed in International Patent Applications WO 2008/086916 and WO 2007/131656, are also used with particular preference.

Examples of amylases preparable according to the present invention are the ←amylases from *Bacillus licheniformis*, from *B. amyloliquefaciens*, or from *B. stearothermophilus*, and the further developments thereof improved for use in washing or cleaning agents. The enzyme from *B. licheniformus* is available from Novozymes under the name Termamyl®, and from Genencor under the name Purastar® ST. Further developed products of this ←amylase are available from Novozymes under the trade names Duramyl® and Termamyl® ultra, from Genencor under the name Purastar® OxAm, and from Daiwa Seiko Inc., Tokyo, Japan, as Keistase®. The ←amylase from *B. amyloliquefaciens* is marketed by Novozymes under the name BAN®, and derived variants of the ←amylase from *B. stearothermophilus* are marketed, again by Novozymes, under the names BSG® and Novamyl®.

Additionally to be highlighted for this purpose are the ←amylase from *Bacillus* sp. A 7-7 (DSM 12368) and the cyclodextrin-glucanotransferase (CGTase) from *B. agaradherens* (DSM 9948). Also usable are the amylolytic enzymes that belong to the sequence space of ←amylases that is defined in International Patent Application WO 03/002711 A2, and that are described in Application WO 03/54177 A2. Fusion products of the aforesaid molecules are likewise usable.

Further developments of the ←amylase from *Aspergillus niger* and *A. oryzae*, obtainable from Novozymes under the trade names Fungamyl®, are also suitable. Further usable commercial products include Amylase-LT® and Stainzyme® or Stainzyme Ultra®, or Stainzyme Plus®, the latter likewise from Novozymes. Variants of these enzymes obtainable by point mutations can also be used according to the present invention.

Examples of lipases or cutinases preparable according to the present invention, which are present because of their triglyceride-cleaving activities but also in order to generate peracids in situ from suitable precursors are lipases obtainable originally from Humicola lanuginosa (*Thermomyces lanuginosus*) or further-developed lipases, in particular those having the D96L amino acid exchange. They are marketed, for example, by the Novozymes company under the trade names Lipolase®, Lipolase® Ultra, LipoPrime®, Lipozyme®, and Lipex®.

Cutinases originally isolated from *Fusarium solani pisi* and *Humicola insolens* are moreover usable, for example. Similarly usable lipases are obtainable from the Amano company under the designations Lipase CO, Lipase P®, Lipase B®, or Lipase CES®, Lipase AKG®, *Bacillis* sp. Lipase®, Lipase AP®, Lipase M-AP®, and Lipase AML®. The lipases and cutinases from, for example, the Genencor Company, whose starting enzymes were originally isolated from *Pseudomonas mendocina* and *Fusarium solanii*, are usable. To be mentioned as further important commercial products are the preparations M1 Lipase® and Lipomax® originally marketed by the Gist-Brocades company, and the enzymes marketed by Meito Sangyo KK, Japan, under the names Lipase MY-30®, Lipase OF®, and Lipase PL®, as well as the Lumafast® product of the Genencor company.

Washing or cleaning agents according to the present invention can furthermore contain cellulases as (depending on the purpose) pure enzymes, enzyme preparations, or in the form of mixtures in which the individual components advantageously complement one another in terms of their various performance aspects. Among these performance aspects are, in particular, contributions to primary washing performance, to secondary washing performance of the agent (anti-redeposition effect or graying inhibition), to avivage (fabric effect), or even the exertion of a "stone-washed" effect.

A usable fungus-based cellulase preparation rich in endoglucanase (EG), and its further developments, are offered by the Novozymes company under the trade name Celluzyme®. The products Endolase® and Carezyme®, likewise obtainable from the Novozymes company, are based on the 50 kD EG and 43 kD EG, respectively, from *H. insolens* DSM 1800. Further usable commercial products of this company are Celluzoft®, Renozyme®, and Celluclean®. Also usable are, for example, the 20 kD EGs from Melanocarpus that are available from the AB Enzymes company, Finland, under the trade names Ecostone® and Biotouch®. Other suitable commercial products of the AB Enzymes company are Econase® and Ecopulp®. Other suitable cellulases are from *Bacillus* sp. CBS 670.93 and CBS 669.83, the one from *Bacillus* sp. CBS 670.93 being obtainable from the Genencor company under the trade name Puradax®. Other commercial products of the Genencor company are "Genencor detergent cellulase L" and IndiAge® Neutra.

In particular, in order to remove certain problem stains, it is also possible to use further enzymes grouped under the term "hemicellulases." These include mannanases, xanthanlyases, pectinlyases pectinases), pectinesterases, pectatelyases, xyloglucanases (=xylanases), pullulanases, and ®-glucanases. Enzymes suitable in this context are obtainable, for example, under the names Gamanase® and Pektinex AR® from the Novozymes company, under the name Rohapec® B1L from the AB Enzymes company, and under the name Pyrolase® from Diversa Corp., San Diego, Calif., USA. The ®-glucanase recovered from *Bacillus subtilis* is available under the name Cereflo® from the Novozymes company. Hemicellulases particularly preferred according to the present invention are mannanases, which are marketed, for example, under the trade names Mannaway® by the Novozymes firm or Purabrite® by the Genencor firm.

To enhance the bleaching effect, agents according to the present invention can also contain oxidoreductases, for example, oxidases, oxygenases, catalases (which react as a peroxidase at low $H_2O_2$ concentrations), peroxidases such as halo-, chloro-, bromo-, lignin, glucose, or manganese peroxidases, dioxygenases, or laccases (phenoloxidases, polyphenoloxidases). Denilite® 1 and 2 of the Novozymes company may be recited as suitable commercial products. Reference is made to Applications WO 98/45398 A1, WO 2005/056782 A2, and WO 2004/058961 A1 as advantageously usable examples of systems for enzymatic perhydrolysis. A combined enzymatic bleaching system encompassing an oxidase and a perhydrolase is described by Application WO 2005/124012. Advantageously, preferably organic, particularly preferably aromatic compounds that interact with the enzymes are additionally added in order to enhance the activity of the relevant oxidoreductases (enhancers) or, if there is a large difference in redox potentials between the oxidizing enzymes and the stains, to ensure electron flow (mediators).

Enzymes used according to the present invention either derive originally from microorganisms, for example, the genera *Bacillus, Streptomyces, Humicola*, or *Pseudomonas*, and/or are produced in accordance with biotechnological methods known per se by suitable microorganisms, for example, by transgenic expression hosts of the *Bacillus* species, or by filamentous fungi.

Purification of the relevant enzymes is favorably accomplished using methods established per se, for example by precipitation, sedimentation, concentration, filtration of the liquid phases, microfiltration, ultrafiltration, action of chemicals, deodorization, or suitable combinations of these steps.

By analogy with the statements made above, the enzymes can be prepared according to the present invention together with accompanying substances, for example, from fermentation, or with stabilizers.

Among all these enzymes, those particularly preferred are those that are per se comparatively stable with regard to oxidation or have been stabilized, for example, by mutations, particularly by substitution, deletion, or insertion of one or more amino acids. Among these may be listed in particular the previously mentioned commercial products Everlase and Purafect® OxP as examples of such proteases, and Duramyl as an example of such an α-amylase.

A separate subject of the invention is represented by the use of a washing or cleaning agent according to the present invention to remove stains, in particular protease-sensitive stains, on textiles or hard surfaces, i.e. to clean textiles or hard surfaces.

This is because agents according to the present invention can advantageously be used to eliminate corresponding impurities from textiles or from hard surfaces, particularly because of the above-described properties of the protease contained. Embodiments of this subject of the invention are represented, for example, by hand laundering, manual removal of spots from textiles or from hard surfaces, or use in conjunction with an automatic method.

All facts, subjects, and embodiments described for washing or cleaning agents according to the present invention are also applicable to this subject of the invention. Reference is therefore explicitly made at this juncture to the disclosure at the corresponding location, with the instruction that the disclosure is also applicable to the present use according to the present invention.

In preferred embodiments of this use, the relevant washing or cleaning agents according to the present invention are made available according to one of the embodiments described.

A further subject of the invention is represented by methods for cleaning textiles or hard surfaces in which in at least one of the method steps, a washing or cleaning agent according to the present invention is used. The method for cleaning textiles or hard surfaces is accordingly characterized in that in at least one method step, a washing or cleaning agent according to the present invention is utilized.

Included are both manual and automatic methods, automatic methods being preferred because of their more precise controllability with regard, for example, to the quantities and contact times used.

Methods for cleaning textiles are generally notable for the fact that, in multiple method steps, various substances having cleaning activity are applied onto the material to be cleaned and are washed out after the contact time, or that the material to be cleaned is treated in another fashion with a washing agent or a solution or dilution of said agent. The same applies correspondingly to methods for cleaning all materials other than textiles, in particular hard surfaces. All conceivable washing or cleaning methods can be supplemented, in at least one of the method steps, by the application of a washing or cleaning agent according to the present invention, and then represent embodiments of the present invention.

All facts, subjects, and embodiments described for washing or cleaning agents according to the present invention are also applicable to this subject of the invention. Reference is therefore made at this juncture to the disclosure at the corresponding location, with the instruction that said disclosure is also applicable to the present use according to the present invention.

A further subject of the invention is represented by methods for cleaning textiles or hard surfaces characterized in that in at least one method step, a protease having an amino acid sequence that is at least 97.5%, and increasingly preferably at least 98%, 98.1%, 98.2%, 98.3%, 98.4%, 98.5%, 98.6%, 98.7%, 98.8%, 98.9%, 99%, 99.1%, 99.2%, 99.3%, 99.4%, 99.5%, 99.6%, 99.7%, 99.8%, 99.9%, and very particularly 100% identical to the amino acid sequence indicated in SEQ ID NO. 3, is catalytically active, in particular in such a way that the protease is used in a quantity from 40 μg to 4 g, preferably from 50 μg to 3 g, particularly preferably from 100 μg to 2 g, and very particularly preferably from 200 μg to 1 g per utilization. All facts, subjects, and embodiments that are described for washing or cleaning agents according to the present invention are also applicable to this subject of the invention. Reference is therefore explicitly made at this juncture to the disclosure at the corresponding location, with the instruction that said disclosure is also applicable to the present use according to the present invention.

Because the proteases used in agents according to the present invention already possess hydrolytic activity and display it even in media that otherwise possess no cleaning power, for example, in plain buffer, a single and/or the only step of such a method can consist in bringing such a protease, if desired as the only component having cleaning activity, into contact with the stain, preferably in a buffer solution or in water. This represents a further embodiment of this subject of the invention.

Alternative embodiments of this subject of the invention are also represented by methods for treating textile raw materials or for textile care, in which in at least one method step, a protease used in agents according to the present invention becomes active. Preferred are methods for textile raw materials, fibers, or textiles having natural constituents, and very particularly for those having wool or silk.

These can be, for example, methods in which materials for processing into textiles are prepared, e.g. for anti-felting treatment, or, for example, methods that supplement the cleaning of already-worn textiles with a care-providing component. Because of the above-described action of proteases on natural protein-containing raw materials, preferred embodiments refer to methods for treating textile raw materials, fibers, or textiles having natural constituents, in particular having wool or silk.

Proteases used in agents according to the present invention are, in accordance with the statements above, advantageously usable in washing and cleaning agents and in methods according to the present invention, in particular in washing and cleaning methods. They can therefore be used to eliminate protein-containing or protease-sensitive stains from textiles or hard surfaces.

A further subject of the invention is therefore constituted by the use of a protease having an amino acid sequence that is at least 97.5%, and increasingly preferably at least 98%, 98.1%, 98.2%, 98.3%, 98.4%, 98.5%, 98.6%, 98.7%, 98.8%, 98.9%, 99%, 99.1%, 99.2%, 99.3%, 99.4%, 99.5%, 99.6%, 99.7%, 99.8%, 99.9%, and very particularly 100% identical to the amino acid sequence indicated in SEQ ID NO. 3, to clean textiles or hard surfaces. The protease is used preferably in a quantity from 40 μg to 4 g, by preference from 50 μg to 3 g, particularly preferably from 100 μg to 2 g, and very particularly preferably from 200 μg to 1 g per utilization. All facts, subjects, and embodiments that are described for washing or cleaning agents according to the present invention are also applicable to this subject of the invention. Reference is therefore explicitly made at this juncture to the disclosure at the corresponding location, with the instruction that said disclosure is also applicable to the present use according to the present invention. In a preferred embodiment of this use, the relevant enzymes are made available in the context of a washing or cleaning agent according to the present invention.

All the molecular-biological working steps follow standard methods such as those indicated, for example, in the manual of Fritsch, Sambrook, and Maniatis, "Molecular cloning: a laboratory manual," Cold Spring Harbor Laboratory Press, New York, 1989, or comparable relevant works. Enzymes and kits were used in accordance with the respective manufacturer's instructions.

EXAMPLES

Isolation and Identification of the Proteolytically Active Bacterial Strain 0.1 g of a soil sample was suspended in 1 ml sterile 0.9% NaCl solution and plated out onto agar plates containing milk powder (1.5% agar, 0.1% $K_2HPO_4$, 0.5% yeast extract, 1% peptone, 1% milk powder, 0.02% $MgSO_4*7H_2O$, 0.4% $Na_2CO_3$, pH 10) and incubated at 30° C. On the basis of a clear zone, a proteolytically active bacterium that was identified by the German Collection of Microorganisms and Cell Cultures (DSMZ) as *Bacillus pumilus* (ID 08-101) was isolated.

Isolation and Cloning of the Novel Serine Protease from the Soil

Proteolytically active bacterium was cultured in TBY medium (0.5% NaCl, 0.5% yeast extract, 1% tryptone, pH 7.4) for 16 hours at 30° C. The complete DNA of this bacterium was prepared using standard methods, treated with the Sau 3A restriction enzyme, and cloned into a *Bacillus* vector (derivative of pBC 16; Bernhard et al. (1978), J. Bacteriol., Vol. 133 (2), pp. 897 ff.). This vector was transformed into the protease-negative host strain *Bacillus subtilis* DB 104 (Kawamura and Doi (1984), J. Bacteriol., Vol. 160 (1), pp. 442-444).

The transformands were first regenerated on DM3 medium and then inoculated onto agar plates containing milk powder (TBY skim milk plates; see Example 1). Proteolytically active clones were identified on the basis of their lysis zones. Of the proteolytically active clones obtained, one was selected, its plasmid (vector) was isolated, and the gene fragment (insert) contained in that vector was sequenced using standard methods.

The insert contains an open reading frame of approximately 1.2 kb whose DNA sequence codes for a protease of the subtilisin type. The sequence was amplified by PCR, cloned into the pUC19 *E. coli* vector, and deposited at the DSMZ under number DSM 21890, in accordance with the Budapest Treaty.

Determining the Cleaning Performance of a Commercially Usual Liquid Washing Agent Containing the Protease—

Standardized stained textiles that had been procured from EMPA Testmaterialien AG (St. Gallen, Switzerland), from wfk Testgewebe GmbH (Brüggen-Bracht, Germany), or from the Center for Testmaterials (CFT, Vlaardingen, Netherlands) were used for this example. The following stains and textiles were utilized:

A: grass on cotton: product no. 164 of Eidgenossische Material- and Prüfanstalt (EMPA) Testmaterialien AG [Federal materials and testing agency, Testmaterials], St. Gallen, Switzerland;

B: peanut oil-pigment/ink on polyester/cotton: product no. PC-10 of CFT (Center for Testmaterials) B.V., Vlaardingen, Netherlands;

C: chocolate-milk/carbon black on cotton: product no. C-03 of CFT (Center for Testmaterials) B.V., Vlaardingen, Netherlands;

D: blood-milk/ink on cotton: product no. C-05 obtainable from CFT (Center for Testmaterials) B.V., Vlaardingen, Netherlands With this test material, a variety of washing-agent formulations were investigated in terms of their cleaning performance. For this, batches were washing for 60 minutes at a temperature of 40° C. The dosing ratio was 5.9 g of washing agent per liter of washing bath. Washing was performed using tap water having a water hardness of approximately 16° German hardness.

A basic washing agent formulation of the following composition was used as a control washing agent (all indications in percentage by weight): 0.3 to 0.5% xanthan gum, 0.2 to 0.4% antifoaming agent, 6 to 7% glycerol, 0.3 to 0.5% ethanol, 4 to 7% FAEOS (fatty alcohol ether sulfate), 24 to 28% nonionic surfactants, 1% boric acid, 1 to 2% sodium citrate (dihydrate), 2 to 4% soda, 14 to 16% coconut fatty acid, 0.5% HEDP (1-hydroxyethane-(1,1-diphosphonic acid)), 0 to 0.4% PVP (polyvinylpyrrolidone), 0 to 0.05% optical brighteners, 0 to 0.001% dye, remainder deionized water. For the various experimental series, the basic washing agent formulation had the following proteases added to it on an equal-activity basis (5 PU/ml final concentration): protease comprising an amino acid sequence in accordance with SEQ ID NO. 3 (batch 1); protease from *Bacillus pumilus* in accordance with WO 2007/131656 (batch 2); and improved-performance variant F49 of the protease from *Bacillus lentus* in accordance with WO 95/23221 (batch 3).

After washing, the whiteness of the washed textiles was measured. The measurement was carried out on a Minolta CM508d spectrometer (D65 illumination, 10°). The unit had previously been calibrated using a white standard provided with the unit. The results obtained are the difference in reflectance values between a washing operation using a washing agent containing a protease, and a concurrently performed control washing operation using a washing agent having no protease. The results are summarized in Table 1 below and allow an immediate conclusion as to the contribution made by the particular contained enzyme to the cleaning performance of the agent being used.

TABLE 1

Washing results with a liquid washing agent at 40° C.

| Stain | Batch 1 | Batch 2 | Batch 3 |
|---|---|---|---|
| A | 6.5 | 4.5 | 4.8 |
| B | 9.1 | 7.8 | 8.5 |
| C | 7.2 | 4.3 | 5.7 |
| D | 18.4 | 15.5 | 16.6 |

It is evident that a washing agent according to the present invention exhibits better cleaning performance as compared with a washing agent having a protease from *Bacillus pumilus* that has a similar amino-acid sequence, and even as compared with a washing agent that contains a protease variant, already of improved performance, that is not a wild-type molecule.

SEQUENCE LISTING

<160> NUMBER OF SEQ ID NOS: 4

<210> SEQ ID NO 1
<211> LENGTH: 1152
<212> TYPE: DNA
<213> ORGANISM: Bacillus pumilus
<220> FEATURE:
<221> NAME/KEY: CDS
<222> LOCATION: (1)..(1149)
<220> FEATURE:
<221> NAME/KEY: mat_peptide
<222> LOCATION: (325)..()

<400> SEQUENCE: 1

```
atg tgc gtg aaa  aag aaa aat gtg atg  aca agt gtt tta ttg gct gtc     48
Met Cys Val Lys  Lys Lys Asn Val Met  Thr Ser Val Leu Leu Ala Val
            -105                 -100                 -95

cct ctt ctg ttt tca gca ggg ttt gga gga tcc atg gca aat gcc gaa      96
Pro Leu Leu Phe Ser Ala Gly Phe Gly Gly Ser Met Ala Asn Ala Glu
        -90                 -85                 -80

acg gtc tcc aaa aca gat agt gaa aaa agc tat att gtt ggt ttt aaa     144
Thr Val Ser Lys Thr Asp Ser Glu Lys Ser Tyr Ile Val Gly Phe Lys
    -75                 -70                 -65

gcc tct gcc acc aca aac agc tct aag aaa caa gct gtc att caa aat     192
Ala Ser Ala Thr Thr Asn Ser Ser Lys Lys Gln Ala Val Ile Gln Asn
-60                 -55                 -50                 -45

ggt gga aaa cta gaa aaa caa tac cgc ctc att aat gct gca caa gtg     240
Gly Gly Lys Leu Glu Lys Gln Tyr Arg Leu Ile Asn Ala Ala Gln Val
                -40                 -35                 -30

aaa atg tcc gaa caa gcc gcc aag aaa ctt gaa cat gac cct agc att     288
Lys Met Ser Glu Gln Ala Ala Lys Lys Leu Glu His Asp Pro Ser Ile
            -25                 -20                 -15

gct tac gta gaa gaa gac cat aaa gca gaa gca tat gca caa acc gtc     336
Ala Tyr Val Glu Glu Asp His Lys Ala Glu Ala Tyr Ala Gln Thr Val
        -10                 -5              -1  1

cct tat gga atc cct caa atc aaa gct cca gct gta cac gct caa ggt     384
Pro Tyr Gly Ile Pro Gln Ile Lys Ala Pro Ala Val His Ala Gln Gly
5                   10                  15                  20

tat aaa ggt gct aat gtc aaa gta gct gtc ctt gat act gga atc cac     432
Tyr Lys Gly Ala Asn Val Lys Val Ala Val Leu Asp Thr Gly Ile His
                25                  30                  35

gct gca cac cct gac tta aat gtt gca ggc ggt gcg agc ttc gtc cct     480
Ala Ala His Pro Asp Leu Asn Val Ala Gly Gly Ala Ser Phe Val Pro
            40                  45                  50

tca gag cca aat gcc acc caa gac ttt caa tca cat gga act cac gta     528
Ser Glu Pro Asn Ala Thr Gln Asp Phe Gln Ser His Gly Thr His Val
        55                  60                  65

gca gga acc att gct gcc ctt gat aac aca att ggt gtt ctt ggg gtc     576
Ala Gly Thr Ile Ala Ala Leu Asp Asn Thr Ile Gly Val Leu Gly Val
    70                  75                  80

gct cca agc gct tcc cta tat gct gtg aaa gta tta gac cgt aat ggc     624
Ala Pro Ser Ala Ser Leu Tyr Ala Val Lys Val Leu Asp Arg Asn Gly
85                  90                  95                  100

gac gga caa tac agc tgg att att agc ggt att gaa tgg gct gta gcg     672
Asp Gly Gln Tyr Ser Trp Ile Ile Ser Gly Ile Glu Trp Ala Val Ala
                105                 110                 115

aat aac atg gat gtc atc aat atg agc tta ggc gga cca aac ggc tcc     720
Asn Asn Met Asp Val Ile Asn Met Ser Leu Gly Gly Pro Asn Gly Ser
            120                 125                 130

aca gcg ctt aaa aat gct gtt gac aca gcg aat aac cgc gga gta gtt     768
Thr Ala Leu Lys Asn Ala Val Asp Thr Ala Asn Asn Arg Gly Val Val
```

```
        135                 140                 145

gtc gtt gcc gca gca gga aat tca ggt tca ttt ggc tct act agc acc      816
Val Val Ala Ala Ala Gly Asn Ser Gly Ser Phe Gly Ser Thr Ser Thr
    150                 155                 160

gtt ggc tat cca gca aaa tac gat tct aca att gct gtt gcc aat gta      864
Val Gly Tyr Pro Ala Lys Tyr Asp Ser Thr Ile Ala Val Ala Asn Val
165                 170                 175                 180

aac agt aac aat gtc aga aac tca tct tct agc gca ggt cct gaa tta      912
Asn Ser Asn Asn Val Arg Asn Ser Ser Ser Ser Ala Gly Pro Glu Leu
                185                 190                 195

gat gtt tct gca cct ggt act tct att tta agt acg gtg cca agc agt      960
Asp Val Ser Ala Pro Gly Thr Ser Ile Leu Ser Thr Val Pro Ser Ser
            200                 205                 210

gga tac act tct tat act gga aca tct atg gcg tct cct cat gta gca     1008
Gly Tyr Thr Ser Tyr Thr Gly Thr Ser Met Ala Ser Pro His Val Ala
        215                 220                 225

gga gca gca gcg ctt atc ctt tct aag tat ccg aat cta tca act tct     1056
Gly Ala Ala Ala Leu Ile Leu Ser Lys Tyr Pro Asn Leu Ser Thr Ser
    230                 235                 240

cag gtt cgc cag cgc tta gaa aac acg gca aca ccg ctt ggt gac tca     1104
Gln Val Arg Gln Arg Leu Glu Asn Thr Ala Thr Pro Leu Gly Asp Ser
245                 250                 255                 260

ttc tat tac gga aaa ggg tta atc aac gtt caa gcg gct tct aac taa     1152
Phe Tyr Tyr Gly Lys Gly Leu Ile Asn Val Gln Ala Ala Ser Asn
                265                 270                 275


<210> SEQ ID NO 2
<211> LENGTH: 383
<212> TYPE: PRT
<213> ORGANISM: Bacillus pumilus

<400> SEQUENCE: 2

Met Cys Val Lys  Lys Lys Asn Val Met  Thr Ser Val Leu Leu Ala Val
            -105                -100                -95

Pro Leu Leu Phe Ser Ala Gly Phe Gly Gly Ser Met Ala Asn Ala Glu
        -90                 -85                 -80

Thr Val Ser Lys Thr Asp Ser Glu Lys Ser Tyr Ile Val Gly Phe Lys
    -75                 -70                 -65

Ala Ser Ala Thr Thr Asn Ser Ser Lys Lys Gln Ala Val Ile Gln Asn
-60                 -55                 -50                 -45

Gly Gly Lys Leu Glu Lys Gln Tyr Arg Leu Ile Asn Ala Ala Gln Val
                -40                 -35                 -30

Lys Met Ser Glu Gln Ala Ala Lys Lys Leu Glu His Asp Pro Ser Ile
            -25                 -20                 -15

Ala Tyr Val Glu Glu Asp His Lys Ala Glu Ala Tyr Ala Gln Thr Val
        -10                 -5              -1  1

Pro Tyr Gly Ile Pro Gln Ile Lys Ala Pro Ala Val His Ala Gln Gly
5                   10                  15                  20

Tyr Lys Gly Ala Asn Val Lys Val Ala Val Leu Asp Thr Gly Ile His
                25                  30                  35

Ala Ala His Pro Asp Leu Asn Val Ala Gly Gly Ala Ser Phe Val Pro
            40                  45                  50

Ser Glu Pro Asn Ala Thr Gln Asp Phe Gln Ser His Gly Thr His Val
        55                  60                  65

Ala Gly Thr Ile Ala Ala Leu Asp Asn Thr Ile Gly Val Leu Gly Val
    70                  75                  80

Ala Pro Ser Ala Ser Leu Tyr Ala Val Lys Val Leu Asp Arg Asn Gly
85                  90                  95                  100
```

```
Asp Gly Gln Tyr Ser Trp Ile Ile Ser Gly Ile Glu Trp Ala Val Ala
                105                 110                 115

Asn Asn Met Asp Val Ile Asn Met Ser Leu Gly Gly Pro Asn Gly Ser
            120                 125                 130

Thr Ala Leu Lys Asn Ala Val Asp Thr Ala Asn Asn Arg Gly Val Val
        135                 140                 145

Val Val Ala Ala Ala Gly Asn Ser Gly Ser Phe Gly Ser Thr Ser Thr
    150                 155                 160

Val Gly Tyr Pro Ala Lys Tyr Asp Ser Thr Ile Ala Val Ala Asn Val
165                 170                 175                 180

Asn Ser Asn Asn Val Arg Asn Ser Ser Ser Ser Ala Gly Pro Glu Leu
                185                 190                 195

Asp Val Ser Ala Pro Gly Thr Ser Ile Leu Ser Thr Val Pro Ser Ser
            200                 205                 210

Gly Tyr Thr Ser Tyr Thr Gly Thr Ser Met Ala Ser Pro His Val Ala
        215                 220                 225

Gly Ala Ala Ala Leu Ile Leu Ser Lys Tyr Pro Asn Leu Ser Thr Ser
    230                 235                 240

Gln Val Arg Gln Arg Leu Glu Asn Thr Ala Thr Pro Leu Gly Asp Ser
245                 250                 255                 260

Phe Tyr Tyr Gly Lys Gly Leu Ile Asn Val Gln Ala Ala Ser Asn
                265                 270                 275


<210> SEQ ID NO 3
<211> LENGTH: 275
<212> TYPE: PRT
<213> ORGANISM: Bacillus pumilus

<400> SEQUENCE: 3

Ala Gln Thr Val Pro Tyr Gly Ile Pro Gln Ile Lys Ala Pro Ala Val
1               5                   10                  15

His Ala Gln Gly Tyr Lys Gly Ala Asn Val Lys Val Ala Val Leu Asp
            20                  25                  30

Thr Gly Ile His Ala Ala His Pro Asp Leu Asn Val Ala Gly Gly Ala
        35                  40                  45

Ser Phe Val Pro Ser Glu Pro Asn Ala Thr Gln Asp Phe Gln Ser His
    50                  55                  60

Gly Thr His Val Ala Gly Thr Ile Ala Ala Leu Asp Asn Thr Ile Gly
65                  70                  75                  80

Val Leu Gly Val Ala Pro Ser Ala Ser Leu Tyr Ala Val Lys Val Leu
                85                  90                  95

Asp Arg Asn Gly Asp Gly Gln Tyr Ser Trp Ile Ile Ser Gly Ile Glu
            100                 105                 110

Trp Ala Val Ala Asn Asn Met Asp Val Ile Asn Met Ser Leu Gly Gly
        115                 120                 125

Pro Asn Gly Ser Thr Ala Leu Lys Asn Ala Val Asp Thr Ala Asn Asn
    130                 135                 140

Arg Gly Val Val Val Val Ala Ala Ala Gly Asn Ser Gly Ser Phe Gly
145                 150                 155                 160

Ser Thr Ser Thr Val Gly Tyr Pro Ala Lys Tyr Asp Ser Thr Ile Ala
                165                 170                 175

Val Ala Asn Val Asn Ser Asn Asn Val Arg Asn Ser Ser Ser Ser Ala
            180                 185                 190

Gly Pro Glu Leu Asp Val Ser Ala Pro Gly Thr Ser Ile Leu Ser Thr
        195                 200                 205
```

```
Val Pro Ser Ser Gly Tyr Thr Ser Tyr Thr Gly Thr Ser Met Ala Ser
    210                 215                 220

Pro His Val Ala Gly Ala Ala Ala Leu Ile Leu Ser Lys Tyr Pro Asn
225                 230                 235                 240

Leu Ser Thr Ser Gln Val Arg Gln Arg Leu Glu Asn Thr Ala Thr Pro
                245                 250                 255

Leu Gly Asp Ser Phe Tyr Tyr Gly Lys Gly Leu Ile Asn Val Gln Ala
            260                 265                 270

Ala Ser Asn
        275


<210> SEQ ID NO 4
<211> LENGTH: 269
<212> TYPE: PRT
<213> ORGANISM: Bacillus lentus

<400> SEQUENCE: 4

Ala Gln Ser Val Pro Trp Gly Ile Ser Arg Val Gln Ala Pro Ala Ala
1               5                   10                  15

His Asn Arg Gly Leu Thr Gly Ser Gly Val Lys Val Ala Val Leu Asp
            20                  25                  30

Thr Gly Ile Ser Thr His Pro Asp Leu Asn Ile Arg Gly Gly Ala Ser
        35                  40                  45

Phe Val Pro Gly Glu Pro Ser Thr Gln Asp Gly Asn Gly His Gly Thr
    50                  55                  60

His Val Ala Gly Thr Ile Ala Ala Leu Asn Asn Ser Ile Gly Val Leu
65                  70                  75                  80

Gly Val Ala Pro Ser Ala Glu Leu Tyr Ala Val Lys Val Leu Gly Ala
                85                  90                  95

Asp Gly Arg Gly Ala Ile Ser Ser Ile Ala Gln Gly Leu Glu Trp Ala
            100                 105                 110

Gly Asn Asn Gly Met His Val Ala Asn Leu Ser Leu Gly Ser Pro Ser
        115                 120                 125

Pro Ser Ala Thr Leu Glu Gln Ala Val Asn Ser Ala Thr Ser Arg Gly
    130                 135                 140

Val Leu Val Val Ala Ala Ser Gly Asn Ser Gly Ala Ser Ser Ile Ser
145                 150                 155                 160

Tyr Pro Ala Arg Tyr Ala Asn Ala Met Ala Val Gly Ala Thr Asp Gln
                165                 170                 175

Asn Asn Asn Arg Ala Ser Phe Ser Gln Tyr Gly Ala Gly Leu Asp Ile
            180                 185                 190

Val Ala Pro Gly Val Asn Val Gln Ser Thr Tyr Pro Gly Ser Thr Tyr
        195                 200                 205

Ala Ser Leu Asn Gly Thr Ser Met Ala Thr Pro His Val Ala Gly Ala
    210                 215                 220

Ala Ala Leu Val Lys Gln Lys Asn Pro Ser Trp Ser Asn Val Gln Ile
225                 230                 235                 240

Arg Asn His Leu Lys Asn Thr Ala Thr Ser Leu Gly Ser Thr Asn Leu
                245                 250                 255

Tyr Gly Ser Gly Leu Val Asn Ala Glu Ala Ala Thr Arg
            260                 265
```

We claim:

1. A washing or cleaning agent comprising a polypeptide that is at least 99% identical to the amino acid sequence indicated in SEQ ID NO. 3, wherein the polypeptide has protease activity, and at least one further washing-agent ingredient.

2. The washing or cleaning agent according to claim 1, wherein the further washing-agent ingredient is selected from the group consisting of builder substances, surface-active surfactants, bleaching agents based on organic and/or inorganic peroxygen compounds, bleach activators, water-miscible organic solvents, enzymes, sequestering agents, electrolytes, pH regulators, optical brighteners, anti-gray agents, foam regulators, dyes, scents, and combinations thereof.

3. The washing or cleaning agent according to claim 1, wherein it is present in solid form as a pourable powder having a bulk weight from 300 g/l to 1200 g/l.

4. The washing or cleaning agent according to claim 1, wherein it is present in liquid, gel, or paste form.

5. The washing or cleaning agent according to claim 1, wherein the protease is encased with a substance that is impermeable to the protease at room temperature and/or in the absence of water.

6. The washing or cleaning agent according to claim 1 further comprising at least one additional enzyme.

7. The washing or cleaning agent according to claim 6, wherein the additional enzyme is chosen from a protease, amylase, cellulase, hemicellulase, mannanase, tannase, xylanase, xanthanase, β-glucosidase, carrageenase, perhydrolase, oxidase, oxidoreductase, or a lipase, as well as preferably mixtures thereof.

8. A method of removing protease-sensitive stains on textiles or hard surfaces comprising applying the washing or cleaning agent according to claim 1 onto the textile or hard surface.

9. The method according to claim 8 wherein the protease is catalytically active and present in the agent in an amount of from 40 μg to 4 g.

10. The washing or cleaning agent according to claim 1 wherein the polypeptide is at least 99.1% identical to the amino acid sequence indicated in SEQ ID NO:3.

11. The washing or cleaning agent according to claim 1 wherein the polypeptide is at least 99.2% identical to the amino acid sequence indicated in SEQ ID NO:3.

12. The washing or cleaning agent according to claim 1 wherein the polypeptide is at least 99.3% identical to the amino acid sequence indicated in SEQ ID NO:3.

13. The washing or cleaning agent according to claim 1 wherein the polypeptide is at least 99.4% identical to the amino acid sequence indicated in SEQ ID NO:3.

14. The washing or cleaning agent according to claim 1 wherein the polypeptide is at least 99.5% identical to the amino acid sequence indicated in SEQ ID NO:3.

15. The washing or cleaning agent according to claim 1 wherein the polypeptide is at least 99.6% identical to the amino acid sequence indicated in SEQ ID NO:3.

16. The washing or cleaning agent according to claim 1 wherein the polypeptide is at least 99.7% identical to the amino acid sequence indicated in SEQ ID NO:3.

17. The washing or cleaning agent according to claim 1 wherein the polypeptide is at least 99.8% identical to the amino acid sequence indicated in SEQ ID NO:3.

18. The washing or cleaning agent according to claim 1 wherein the polypeptide is at least 99.9% identical to the amino acid sequence indicated in SEQ ID NO:3.

19. The washing or cleaning agent according to claim 1 wherein the polypeptide is identical to the amino acid sequence indicated in SEQ ID NO. 3.

* * * * *